United States Patent [19]

Binion

[11] Patent Number: 4,561,204

[45] Date of Patent: Dec. 31, 1985

[54] RETICLE DISPLAY FOR SMALL ARMS

[76] Inventor: W. Sidney Binion, P.O. Box 770010, Ste. 15, Houston, Tex. 77215

[21] Appl. No.: 511,096

[22] Filed: Jul. 6, 1983

[51] Int. Cl.[4] ..... F41G 1/38

[52] U.S. Cl. ..... 42/1 ST; 33/245

[58] Field of Search ..... 42/1 ST; 33/245

[56] References Cited

U.S. PATENT DOCUMENTS 3,737,232 6/1973 Milburn, Jr. ..... 33/245

3,992,782 11/1976 Rickert ..... 42/1 ST

*Primary Examiner*—Charles T. Jordan

*Attorney, Agent, or Firm*—Boris Haskell

[57] ABSTRACT

A separate opaque reticle display attachment for a rifle or the like equipped with a telescopic sight. The user sights through the telescopic sight with his bore axis eye while simultaneously viewing an opaque reticle display screen which is aligned with his other eye. The display includes a cross-hairs aiming reticle. Transducers gather information relative to wind velocity and direction, ambient temperature, relative humidity, target elevation, and the like, which affect the ballistic trajectory of a projectile fired from the rifle. This information along with range information is fed to a microprocessor, which adjusts the position of the cross-hairs reticle on the display for proper aiming of the rifle. The user, by simultaneously viewing through the telescopic sight with one eye and viewing the opaque reticle display with the other eye, combines or superposes the two images into a single field of vision to aim the rifle in accordance with the position of the cross-hairs reticle.

8 Claims, 7 Drawing Figures

RETICLE DISPLAY FOR SMALL ARMS

SUMMARY OF INVENTION

The present invention relates to gun sights, and more particularly to a microprocessor controlled auxiliary reticle system adapted for use in conjunction with a telescopic sight for small arms, such as rifles and guns of like character.

Computer controlled or computer assisted gun fire control systems are, of course, well known, particularly in the field of military ordnance. These systems sense such ballistic factors as windage, relative humidity and temperature, and with additional inputs as to the type of ordnance used and target range, they provide appropriate information for ballistic superelevation and windage corrections. This information is then used to control the aiming of the gun, or to provide an appropriate deviation between the gun and a sighting device or sighting reticle.

In accordance with the present invention, the principles of these gun fire control systems are adapted to small arms, particularly rifles and guns of similar character. It is well known to provide a telescopic sight for a rifle, which may contain a cross-hairs reticle. The sight may be provided with a mechanical adjustment for changing the axis of the sight in elevation and azimuth relative to the axis of the rifle barrel, to accommodate for target range and windage. Thus, when properly set, if the cross-hairs reticle is aimed at the target, the bore of the gun will be offset by an amount that will cause the projectile to hit the target. Such devices are set mainly by guesswork and estimates, and require a great deal of skill The present invention provides a separate reticle display for use in combination with a telescopic gun sight, and is essentially an attachment to the telescopic sight, although it may be provided as an integrated adjunct to the telescopic sight. This reticle display may be generated on a liquid crystal diode (LCD), or a small cathode ray tube, or a dot matrix of light emitting diodes, or other analogous display device. One LCD display of this general character is disclosed in U.S. Pat. No. 3,885,861 to Farnsworth et al. A microprocessor is incorporated with the reticle device to generate and position the reticle display. Windage, humidity and temperature sensors are provided as inputs to the microprocessor, along with a range measurement. The microprocessor adjusts the position of the reticle up or down and left or right on a display screen in accordance with these inputs and in accordance with previous calibrations introduced into the microprocessor, to effect a proper deviation between the line of sight to the target and the proper line of aim of the gun barrel to hit the target under the prevailing conditions.

As stated, this reticle display is presented separately from the telescopic sight, and may be an attachment to the sight. It is positioned so that the user, who may be, for example, a sportsman, a military marksman, or a target shooter, looks through the telescopic sight at the target field with his usual bore-axis eye, while simultaneously viewing the reticle display with his other eye. These two views are combined or superimposed by the user's mind into a single field of vision. The user then positions the rifle in elevation and azimuth until he sees the aiming reticle superposed on the target. Since the position of the aiming reticle on the display screen is adjusted in accordance with the ballistics and atmospheric conditions, when it is seen as superposed on the target, the rifle bore is pointed in the proper direction so the projectile will hit the target.

It is therefore one object of the present invention to provide a reticle display device for use with a small arms telescopic sight.

Another object of the present invention is to provide such a device that includes a microprocessor for adjusting the position of the aiming reticle display in accordance with various ballistic factors.

Still another object of the present invention is to provide such a device wherein the user views the reticle display with one eye, while viewing the target field through the telescopic sight with his other eye, providing a single field of vision of the reticle display superposed on the target field.

Other objects and the advantages of the present invention will become apparent to those skilled in the art from a consideration of the following detailed description of one illustrative embodiment of the invention.

BRIEF DESCRIPTION OF DRAWINGS

The following detailed description of one embodiment of the invention is had in conjunction with the accompanying drawings, wherein like reference characters refer to like or corresponding parts, and wherein.

DETAILED DESCRIPTION OF THE INVENTION

Figure 1:
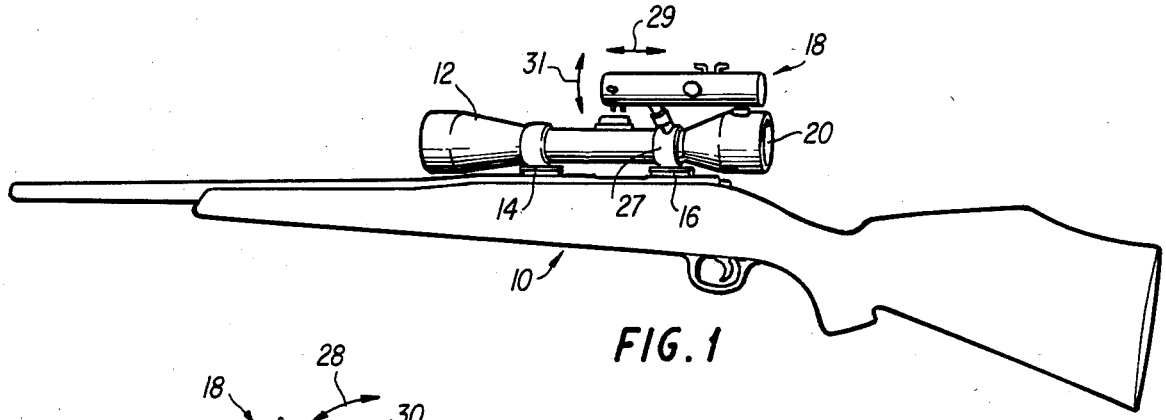
FIG. 1 is a side view of a rifle equipped with a telescopic sight and further having an opaque reticle attachment of the present invention.

Referring to FIG. 1 of the drawings, a rifle is illustrated and indicated generally by the numeral 10. The rifle is provided with a conventional telescopic sight 12, mounted on the rifle at 14 and 16. The rifle is further provided with a reticle display tube, indicated generally by the numeral 18, which is offset from the telescopic sight 12 and extends generally parallel to the axis of the sight. However, aligning the reticle display tube with the telescopic sight is simply a matter of convenience, because the user does not sight through the tube 18, he only observes an opaque display screen 22 therein. Reticle display tube 18 also contains a microprocessor or microcomputer for positioning or locating the reticle display on the screen. The rear lens of telescope 12, designated 20, the opaque reticle display screen 22, and the spatial relation between these elements, is shown best in FIG. 2.

Figure 2:
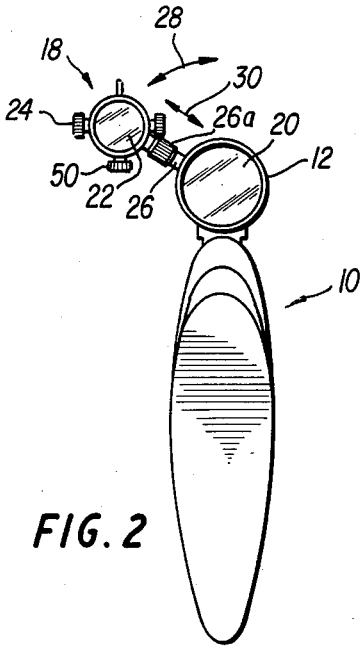
FIG. 2 is a rear view of the apparatus shown in FIG. 1.
Figure 3:
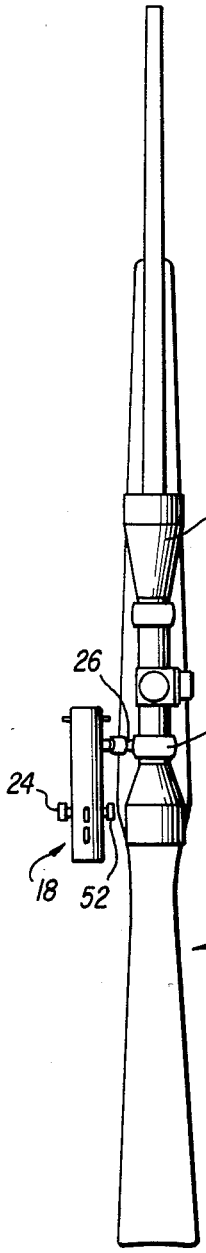
FIG. 3 is a top plan view of the apparatus shown in FIG. 1.

Referring particularly to FIGS. 2 and 3, it will be seen that tube 18 is spaced or offset laterally from the telescopic sight 12 by an attachment bracket means 26. The attachment bracket 26 has an adjustable clamp ring 27 which encircles the body of telescopic sight 12, so that the entire tube 18 may be orbited about the axis of the telescopic sight 12. In the FIG. 2 position, the attachment bracket 26 is shown at an angle of approximately 30 degrees relative to a horizontal line passing through the axis of the telescopic sight 12, and is in the general position for use by a right handed shooter who will use his right eye to sight through the telescopic sight 12 along the bore axis of the rifle, and will use his left eye to view the opaque reticle display face 22 of the reticle display tube 18. The reticle display tube 18 would be orbited clockwise through approximately 120 degrees (as viewed in FIG. 2) to be in position for use by a left handed shooter. That is, a user who would look through the telescopic sight along the rifle bore axis with his left eye, would observe the opaque reticle display screen 22 of the reticle display tube 18 with his right eye.

The arrow 30 in FIG. 2 indicates that the length of bracket 26 is adjustable, such as by telescoping sections, so that the spacing of the reticle tube 18 from the telescopic sight 12 may be varied to compensate for differences in distances between the eyes of different users of the rifle. Once adjusted, the length of bracket 26 may be set by clamp 26*a*. Similarly, in FIG. 1, the arrow 29 indicates that the reticle display tube 18 is capable of being moved a limited amount along a line parallel to the axis of the telescopic sight by moving the clamp 27 along the body of the sight 12. The clamp 27 also affords the orbital adjustment previously mentioned, and indicated by the arrow 28. The arrow 31 indicates that the axis of the display tube 18 may be adjustably tilted about the axis of the bracket 26 through the mechanism of clamp 26*a*. Thus, as a result of the adjustments indicated by arrows 28, 29, 30 and 31, the screen 20 may be accurately positioned to be properly viewed by the appropriate eye of the user. It should be born in mind that the display tube 18 is just a housing and is not a sighting tube; functionally, the user simply sees the display generated on the opaque display screen 20.

Figure 5:
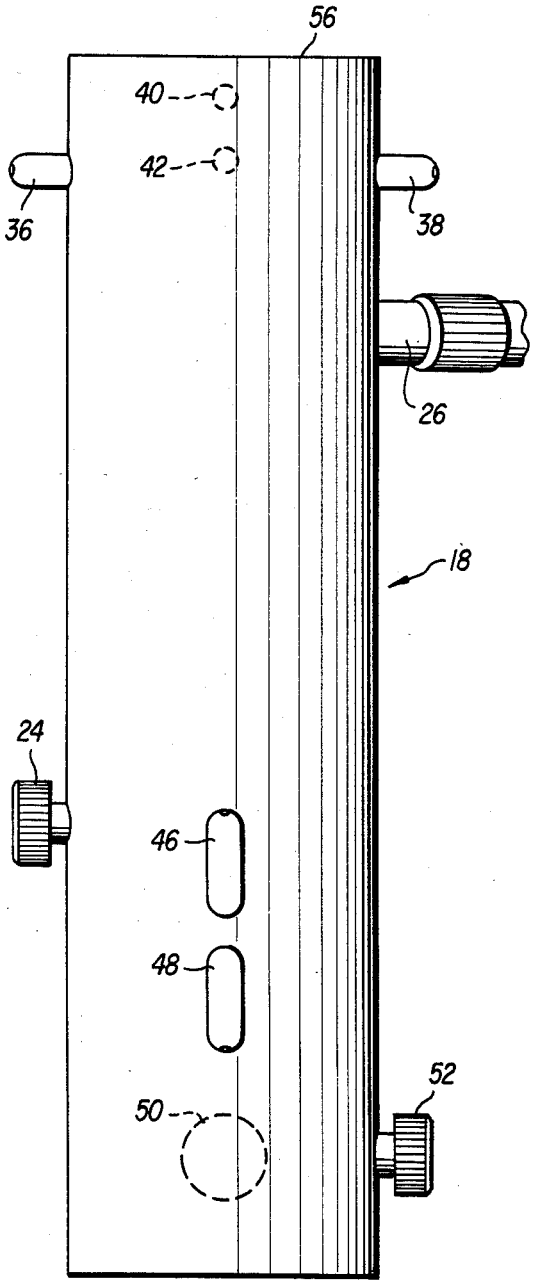
FIG. 5 is a top plan view of the reticle attachment of FIG. 2 drawn to an enlarged scale.
Figure 6:
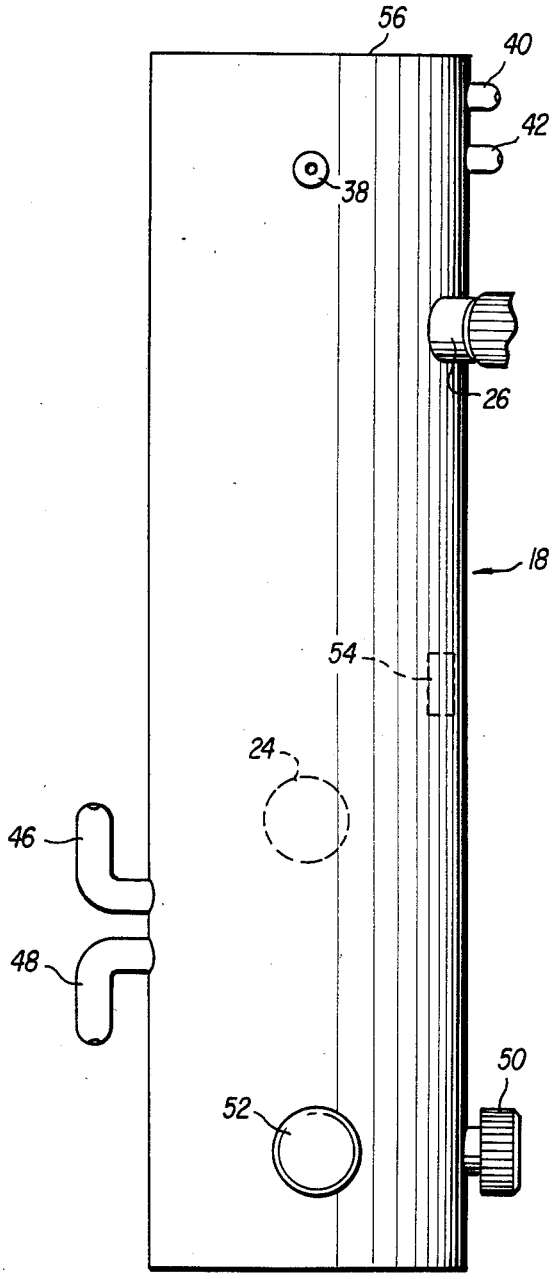
FIG. 6 is a right side elevational view of the reticle attachment of FIG. 5.
Figure 7:
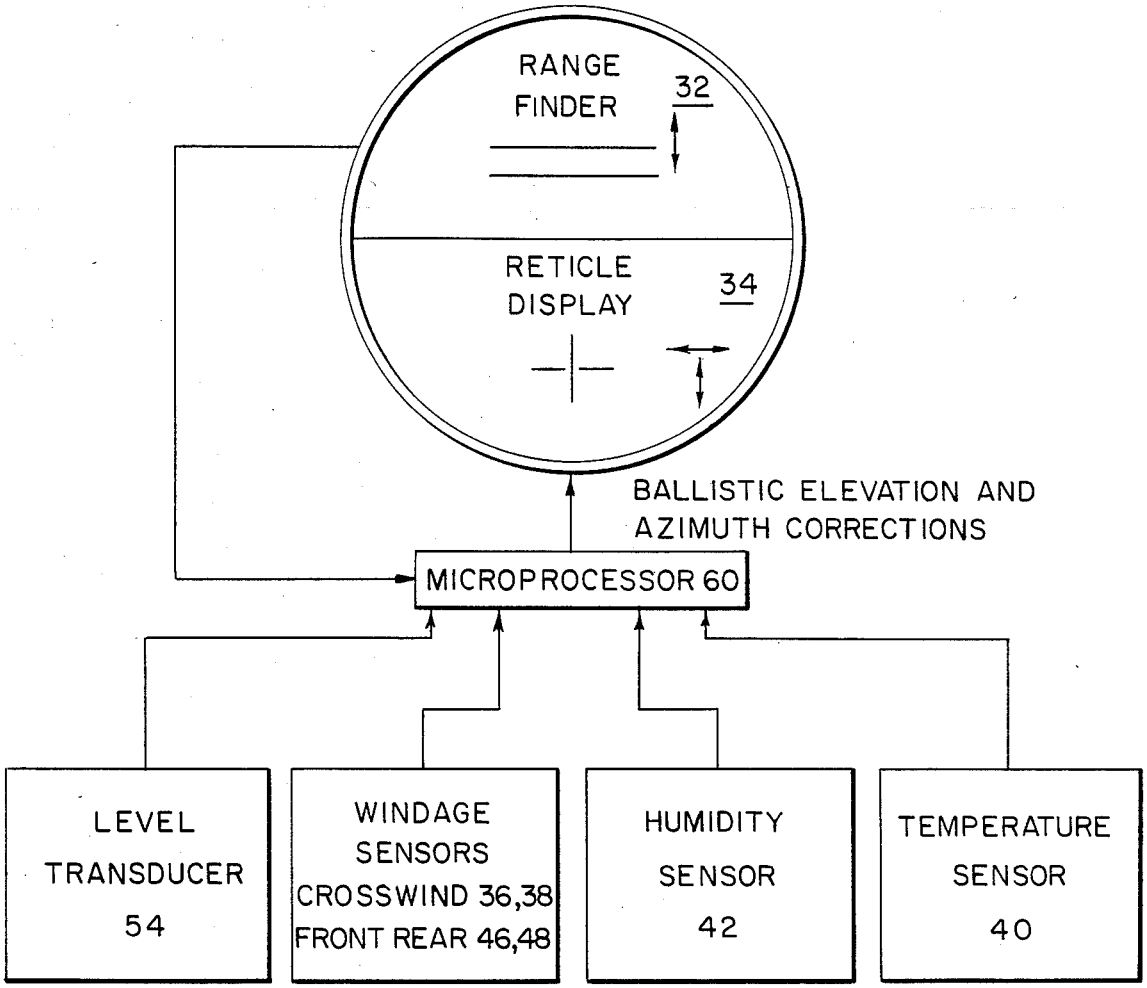
FIG. 7 is a functional block diagram illustrating the operation of the reticle display system of the present invention.

Referring to FIGS. 5 and 6, the atmospheric conditions transducers are illustrated, providing appropriate inputs to the microcomputer contained within the reticle tube 18. These transducers include Pitot tubes 36, 38 to measure cross wind velocity, Pitot tubes 46, 48 to measure frontrear wind velocity, an ambient temperature transducer shown at 40, and a relative humidity transducer at 42. In addition, a level transducer is shown in phantom at 54, to measure the angle of elevation of the rifle bore when sighted at the target. The specific forms of these transducers are, of course, well known in the gun fire control art, and therefore they are not shown in any significant detail herein. The measurements obtained from the transducers provide the appropriate inputs to the microprocessor to compute the appropriate ballistic elevation and azimuth corrections necessary to effect correct aiming of the rifle, which is also well known in the gun fire control art.

Figure 4:
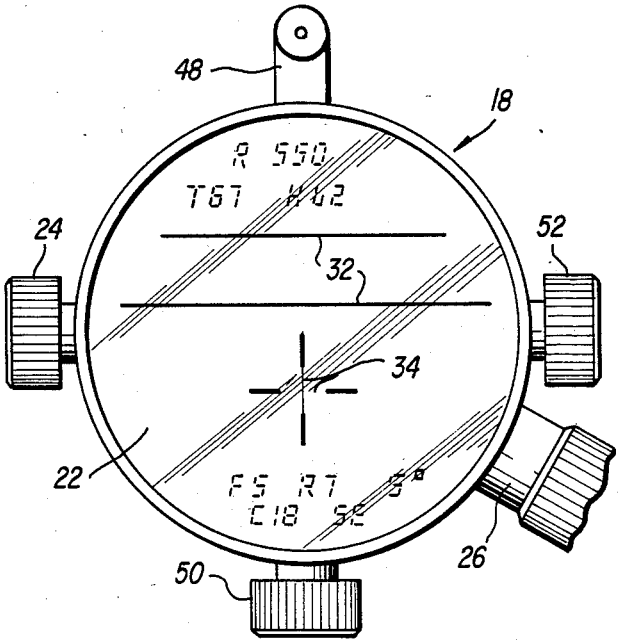
FIG. 4 is an enlarged, fragmentary elevational view principally of the reticle display of FIG. 2.

Referring particularly to FIG. 4, the display appearing on screen 22 is shown. The primary displays comprise the cross-hairs reticle 34, and the spaced lines range finder 32. The range finder is based on the spacing between the lines 32, which is adjustable by turning knob 24. Thus, turning of knob 24 changes the space between the lines 32, and simultaneously provides a corresponding range measurement input to the microprocessor. As previously stated, the user views the target through the telescopic sight 12 with one eye, and views the display screen 22 with his other eye. As a result, the target image and the display screen are superposed or integrated in the user's vision. The range finder is initially callibrated in respect to some target aspect of nearly constant size, such as the bust of a man, or the bust of a deer. When the rifle sight is trained on a like subject, the constant size feature of the target is framed between the lines 32 by enlarging or reducing the space therebetween through rotation of knob 24. When properly framed, the target has been properly ranged, and that range data is inserted in the microprocessor.

As the target range is introduced into the microprocessor in this manner, the microprocessor computes the necessary ballistic superelevation and azimuth deviation in view of the windage, the relative humidity, the temperature, and the line of sight elevation to the target. The resultant output is used to position the cross-hairs reticle 34—e.g. downward as range is increased, to the right if windage is from the left, etc. When the gun is aimed after the range is inserted by setting the spacing between the lines 32 as above described, the user positions the rifle so that in the combined vision of his two eyes, the cross-hairs reticle 34 appears positioned on the target. This action aims the rifle bore at that elevation and azimuth angle which will cause the fired projectile to strike the target.

If desired, the values obtained for range and from the various transducers described above, can be displayed on the screen 22, supplemental to the basic range finder and cross-hairs reticle display.

It is apparent that the present invention can be marketed as a separate adjunct or accessory for use with many different rifles, and can be used for different ammunition. It is further apparent to those skilled in the art that accurate functioning of the reticle display system requires proper calibration. Obviously, the unit can be manufactured as an integral part of a specific rifle, and factory calibrated for that rifle and a specific type of ammunition. For user calibration, knobs 50 and 52 are provided, which may be used to change and reset the position of the cross-hairs reticle display vertically and horizontally, as required, until perfect marksmanship is obtained under given conditions of firing and a given range setting. After calibration, new range measurements and changes in atmospheric conditions cause appropriate changes in the location of the cross-hairs reticle on the screen 22.

Having thus described one specific illustrative embodiment of the invention, it is understood that various modifications and variations will be apparent to those skilled in the art. Such modifications or variations as are embraced by the spirit and scope of the appended claims are contemplated as being within the purview of the present invention. For example, a particular form of range finder is illustrated in the specification operating in conjunction with the display screen and telescopic sight. Obviously, an independent range finder could be used apart from the display screen, and the range finder input knob 24 might simply be marked in range increments to be selected after separate range measurements; or even a range estimate could be used. Also, although it is contemplated that the present invention would be useful primarily in conjunction with a telescopic sight, other sighting arrangements could be used, as for example, a sighting tube, or other gun sight structures.

What is claimed is:

1. A gun sight for small arms having a gun barrel, and for aiming a gun at a target located in a target field, comprising, a telescopic sight for mounting on a gun in axial alignment with the gun barrel and in position to be aligned with a first eye of a user when aiming the gun to observe the target field therethrough, an essentially opaque reticle display means comprising a display screen, a microprocessor, means for generating inputs to said microprocessor including target range and atmospheric conditions affecting projectile ballistic trajectory, means for displaying an aiming reticle on said screen, the position of said aiming reticle on said screen being controlled by said microprocessor in accordance with said inputs, and means for mounting said display screen in offset relation to the sighting axis of said telescopic sight and substantially in alignment with the other eye of a user when sighting through said telescopic sight with said first eye, whereby the users field of vision combines and superposes and target field and the aiming reticle displayed on said screen.

2. A gun sight system for small arms as set forth in claim 1, wherein said means for mounting said display screen in offset relation to the sighting axis of said telescopic sight includes means for adjusting the offset position of said display screen relative to said sighting axis of said telescopic sight.

3. In combination, a small arms weapon having a barrel, sighting means mounted on said weapon aligned with said barrel for aiming the weapon at a target by aligning one eye of a user with said sighting means, reticle means including a non-transparent screen displaying a reticle pattern, means mounting said reticle means on said weapon in offset relation to said sighting means, including means for adjusting the offset position of said screen for alignment with the other eye of said user when said one eye is aligned with said sighting means, whereby the field of vision of said user combines and superposes the view of the target through said one eye with the view of said reticle display screen through said other eye.

4. In a combination as set forth in claim 3, means for varying the position of said reticle pattern on said screen.

5. In a combination as set forth in claim 4, said means mounting said reticle means being adjustable to vary the offset relation of said reticle means to said sighting means.

6. In a combination as set forth in claim 3, said means mounting said reticle means being adjustable to vary the offset relation of said reticle means to said sighting means.

7. In a combination as set forth in claim 3, means for varying the position of said reticle pattern on said screen, including a computer means, and means for generating inputs to said computer means including target range and atmospheric conditions affecting ballistic trajectory.

8. In a combination as set forth in claim 7, said means mounting said reticle means being adjustable to vary the offset relation of said reticle means to said sighting means to accommodate to the eyes of different users.

* * * * *